US008486874B2

(12) United States Patent
Takagi et al.

(10) Patent No.: US 8,486,874 B2
(45) Date of Patent: Jul. 16, 2013

(54) WATER-SOLUBLE PROCESSING OIL AGENT

(75) Inventors: Fumiaki Takagi, Chiba (JP); Masami Yamanaka, Chiba (JP); Hiroshi Kawasaki, Chiba (JP); Youichiro Jido, Chiba (JP); Takashi Urabe, Hiroshima (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 13/259,955

(22) PCT Filed: Mar. 5, 2010

(86) PCT No.: PCT/JP2010/053684

§ 371 (c)(1),
(2), (4) Date: Nov. 22, 2011

(87) PCT Pub. No.: WO2010/113594

PCT Pub. Date: Oct. 7, 2010

(65) Prior Publication Data

US 2012/0058925 A1 Mar. 8, 2012

(30) Foreign Application Priority Data

Mar. 31, 2009 (JP) ..... 2009-088528

(51) Int. Cl.
*C10M 159/12* (2006.01)

(52) U.S. Cl.
USPC ..... 508/454; 508/545

(58) Field of Classification Search
USPC ..... 508/545, 454
See application file for complete search history.

(56) References Cited

U.S. PATENT DOCUMENTS

| | | | | |
|---|---|---|---|---|
| 4,770,803 | A | 9/1988 | Forsberg | |
| 6,413,917 | B1 * | 7/2002 | Yamada et al. | 508/324 |
| 2009/0118151 | A1 | 5/2009 | Sasaki et al. | |

FOREIGN PATENT DOCUMENTS

| | | | | |
|---|---|---|---|---|
| CN | 87 1 04565 | A | | 6/1988 |
| CN | 101213279 | A | | 7/2008 |
| JP | 02 242891 | | | 9/1990 |
| JP | 02242891 | A | * | 9/1990 |
| JP | 04 050299 | | | 2/1992 |
| JP | 07 228867 | | | 8/1995 |
| JP | 07 310086 | | | 11/1995 |
| JP | 10 085872 | | | 4/1998 |
| JP | 10 324887 | | | 12/1998 |
| JP | 2002 285186 | | | 10/2002 |

OTHER PUBLICATIONS

International Search Report Issued Jun. 8, 2010 in PCT/JP10/053684 Filed Mar. 5, 2010.

Combined Chinese Office Action and Search Report issued Nov. 22, 2012 in Patent Application No. 201080015671.5.

* cited by examiner

*Primary Examiner* — Taiwo Oladapo

(74) *Attorney, Agent, or Firm* — Oblon, Spivak, McClelland, Maier & Neustadt, L.L.P.

(57) ABSTRACT

To provide a water-soluble working fluid which less adversely affects the human body and the ecological system as compared with conventional water-soluble working fluids, which has high rotting resistance, and which provides excellent working performance. The water-soluble working fluid of the invention contains methyldicyclohexylamine.

15 Claims, No Drawings

WATER-SOLUBLE PROCESSING OIL AGENT

RELATED APPLICATION

This application is a national stage entry of PCT/JP2010/053684 filed on Mar. 5, 2010 which claims priority from Japanese Patent Application No. 2009-088528, filed Mar. 31, 2009, which is incorporated by reference in its entirety.

TECHNICAL FIELD

The present invention relates to a water-soluble working fluid and, more particularly, to a water-soluble working fluid which less adversely affects the human body, which has high rotting resistance, and which provides excellent machining performance.

BACKGROUND ART

Similar to water-insoluble working fluid, water-soluble working fluid employed in metal working such as cutting is required to provide excellent machining performance. In addition, water-soluble working fluid must have high rotting resistance as an essential characteristic.

Conventionally, in enhancement of the rotting resistance of water-soluble working fluid, a higher alkalinity of the working fluid has been generally employed, and a variety of amine compounds such as cyclohexylamine, dicyclohexylamine, and alkanolamines have been used as alkali substances. Among them, dicyclohexylamine is particularly widely employed, since it provides less pungent odor and has high rotting resistance.

However, dicyclohexylamine has been recently registered as a class 1 chemical substance stipulated by the Pollutant Release and Transfer Register (PRTR) law, in that dicyclohexylamine possibly adversely affects human health and the ecological system. Thus, use of dicyclohexylamine is now less encouraged. Even under such circumstances, there is demand for a new amine compound substitute which enhances working performance and rotting resistance of water-soluble metal working fluid.

As new amine compound substitutes, a variety of amine compounds have been proposed. For example, Patent Document 1 discloses amine compounds having a cycloalkyl group, such as cyclohexylamine and N,N-dimethylcyclohexylamine.

Patent Document 2 discloses amine compounds having an aromatic moiety, such as 4-methoxy-2-methylaniline and N,N-dimethylbenzylamine. Patent Document 3 discloses an amine compound containing triethanolamine or the like, monoisopropanolamine or the like, and cyclohexylamine.

However, these amine compounds is inferior in performance to the aforementioned dicyclohexylamine. Therefore, at present, the purpose of the present invention; i.e., to reduce adverse effects on human health and the ecological system and to enhance rotting resistance, cannot fully be attained.

PRIOR ART DOCUMENTS

Patent Documents

Patent Document 1: Japanese Patent Application Laid-Open (kokai) No. Hei 2-242891

Patent Document 2: Japanese Patent Application Laid-Open (kokai) No. Hei 2-242890

Patent Document 3: Japanese Patent Application Laid-Open (kokai) No. 2002-285186

SUMMARY OF THE INVENTION

Problems to be Solved by the Invention

The present invention has been conceived under such circumstances, and an object of the invention is to provide a water-soluble working fluid which less adversely affects the human body and the ecological system as compared with conventional water-soluble working fluids, which has high rotting resistance, and which provides excellent machining performance.

Means for Solving the Problems

The present inventors have carried out extensive studies in order to attain the aforementioned object, and have found that methyldicyclohexylamine less adversely affects the human body and the ecological system, as compared with dicyclohexylamine, and can enhance rotting resistance and machining performance. The present invention has been accomplished on the basis of this finding.

Accordingly, the present invention provides the following:

(1) a water-soluble working fluid containing methyldicyclohexylamine;

(2) a water-soluble working fluid as described in (1) above, which further contains a fatty acid or a fatty acid derivative; and (3) a water-soluble working fluid containing a methyldicyclohexylamine salt of a fatty acid or a fatty acid derivative.

EFFECTS OF THE INVENTIONS

The present invention enables provision of a water-soluble working fluid which less adversely affects the human body and the ecological system as compared with conventional water-soluble working fluids, which has high rotting resistance, and which provides excellent machining performance.

MODES FOR CARRYING OUT THE INVENTION

The water-soluble working fluid of the present invention contains methyldicyclohexylamine.

The toxicity of methyldicyclohexylamine is considerably lower than that of conventionally employed dicyclohexylamine, which was previously registered as a class 1 chemical substance stipulated by the PRTR law. Table 1 shows the toxicity data of two cyclohexylamine compounds.

TABLE 1

| | Peroral rat | Percutaneous rabbit |
|---|---|---|
| Dicyclohexylamine | $LD_{50}$ 373 mg/kg[1)] | 200 mg/kg < $LD_{50}$ < 316 mg/kg[2)] |
| Methyldicyclohexylamine | $LD_{50}$ 446 mg/kg[1)] | LDLo 2 g/kg[1)] |

Note

[1)]US National Institute for Occupational Safety and Health Registry of Toxic Effects of Chemical Substances (RTECS) Database

[2)]European Chemical Bureau, IUCLID Dataset (2000)

Methyldicyclohexylamine has low toxicity and exhibits excellent rotting resistance.

Methyldicyclohexylamine has low toxicity and can enhance working performance which has conventionally been attained. The enhancement in working performance is thought to be realized by formation of amine soap (fatty acid amine salt) from methyldicyclohexylamine and a variety of fatty acids incorporated into working fluid.

The water-soluble working fluid of the present invention is generally prepared as an undiluted working fluid. In use, the undiluted liquid is appropriately diluted with water in accordance with working conditions. The water-dilution factor is generally about 3 to about 200 fold, preferably about 5 to about 100 fold.

In the present invention, the methyldicyclohexylamine content (concentration) is preferably 1 to 50 mass % (based on undiluted water-soluble working fluid), more preferably 3 to 30 mass %. When the methyldicyclohexylamine content (concentration) is 1 mass % or higher, excellent rotting resistance can be attained, whereas when the content is 50 mass % or lower, a working fluid performance commensurate with the content can be attained.

Preferably, the water-soluble working fluid of the present invention contains methyldicyclohexylamine (hereinafter may be referred to as "ingredient A") and a fatty acid or a fatty acid derivative (ingredient B).

The fatty acid or the fatty acid derivative incorporated into the working fluid forms a fatty acid amine salt with an amine such as methyldicyclohexylamine, whereby working performance is enhanced. The amine salt also serves as an emulsifying agent to enhance emulsion stability and further enhances anti-corrosive performance.

Examples of the fatty acid or fatty acid derivative employed in the water-soluble working fluid include C8 to C30 (preferably C8 to C20) fatty acids, C8 to C30 (preferably C8 to C20) hydroxyfatty acids, C8 to C30 (preferably C8 to C20) aliphatic dicarboxylic acids, dimer acids of the fatty acids, and polycondensates of the hydroxyfatty acids. Preferably, one or more species selected from the above examples are incorporated into the working fluid.

The fatty acids, hydroxyfatty acids, and aliphatic dicarboxylic acids may be linear or branched, or saturated or unsaturated.

Specific examples of the fatty acid include octanoic acid, 2-ethylhexanoic acid, decanoic acid, undecanoic acid, dodecanoic acid, tridecanoic acid, pentadecanoic acid, heptadecanoic acid, nonadecanoic acid, myristic acid, palmitic acid, stearic acid, arachic acid, behenic acid, isostearic acid, elaidic acid, oleic acid, linoleic acid, linolenic acid, hydroxylauric acid, hydroxymyristic acid, hydroxypalmitic acid, hydroxystearic acid, hydroxyarachic acid, hydroxybehenic acid, risinoleic acid, hydroxyoctadecenoic acid, sebacic acid, dodecanedioic acid, dodecylsuccinic acid, laurylsuccinic acid, stearylsuccinic acid, and isostearylsuccinic acid.

Examples of the fatty acid derivative include dimer acids and hydroxyfatty acid condensates (e.g., condensates of licinoleic acid, 12-hydroxystearic acid, etc.; e.g., dimer to hexamer).

In the present invention, the fatty acid or fatty acid derivative content (based on the total amount of working fluid (undiluted liquid)) is preferably 5 to 60 mass %, more preferably 10 to 40 mass %. When the content is 5 mass % or higher, working performance and emulsion stability are enhanced, whereas when the content is 60 mass % or less, a working fluid performance commensurate with the content can be attained.

The fatty acid or fatty acid derivative, ingredient B, may be singly incorporated into the water-soluble working fluid. Alternatively, the fatty acid or fatty acid derivative is reacted in advance with methyldicyclohexylamine (ingredient A), and the reaction product; i.e., an amine salt of the fatty acid or fatty acid derivative (methyldicyclohexylamine salt of the fatty acid or fatty acid derivative) may be incorporated into the water-soluble working fluid.

Through the latter mode of incorporation, the fatty acid amine salt may be present at higher concentration in the water-soluble working fluid, whereby working performance and emulsion stability could be more enhanced.

The above reaction may be performed by, for example, mixing with stirring ingredients A and B in the presence or absence of solvent roughly at room temperature to 80° C.

Generally, the amount of the amine salt of the fatty acid or fatty acid derivative incorporated into the working fluid (based on the total amount of undiluted fluid) is preferably 10 to 70 mass %.

If required, the water-soluble working fluid of the present invention may further contain a basic compound such as an organic amine compound or an alkali metal hydroxide; a surfactant; a lubricating oil base oil such as mineral oil or synthetic oil; a preservative; a metal deactivator, a defoaming agent, or the like.

Examples of the organic amine compound among the basic compounds include alkanolamines such as monoethanolamine, diethanolamine, triethanolamine, mono-n-propanolamine, di(n-propanol)amine, tri(n-propanol)amine, monoisopropanolamine, diisopropanolamine, triisopropanolamine, methylisopropanolamine, 2-amino-2-methyl-1-propanol, N-methylmonoethanolamine, N-ethylmonoethanolamine, N-n-butylmonoethanolamine, N-t-butylmonoethanolamine, N-cyclomonoethanolamine, N-methyldiethanolamine, N-ethyldiethanolamine, N-n-butyldiethanolamine, N-t-butyldiethanolamine, and N-cyclohexyldiethanolamine; and piperazine compounds such as N-(2-hydroxyalkyl)piperazines (e.g., N-(2-hydroxymethyl)piperazine, N-(2-hydroxyethyl) piperazine, and N-(2-hydroxypropyl)piperazine).

Examples of the alkali metal hydroxide include sodium hydroxide, potassium hydroxide, and lithium hydroxide.

These basic compounds can regulates the alkalinity of the water-soluble working fluid and enhance working performance by forming an amine salt or an alkali metal salt with a fatty acid or the like contained in the water-soluble working fluid.

The basic compound content of the working fluid may be adjusted to a neutralization equivalent or thereabout which realize neutralization of acidic components originating from other additives.

No particular limitation is imposed on the surfactant, and a nonionic surfactant, an anionic surfactant, a cationic surfactant, or an amphoteric surfactant may be used. These surfactant may be used in combination. Examples of preferred surfactants include a nonionic surfactant, an anionic surfactant, and a mixture of these surfactants.

Examples of the nonionic surfactant include polyoxyalkylene glycol or a monoether or a diether compound thereof; polyoxyalkylene surfactants such as glycerin or an alkylene oxide adduct thereof, or an ether compound; esters between carboxylic acid and alcohol; amides between alkanolamine and fatty acid or carboxylic acid; and alkylamine alkyleneoxide adducts.

Examples of the anionic surfactant include salts between a carboxylic acid (e.g., a C7 to C22 saturated or unsaturated fatty acid or hydroxyfatty acid) or a sulfonic acid and an amine or a metal; esters between a hydroxyfatty acid (e.g., risinoleic acid) polycondensate and a fatty acid, or and salts of the esters with an amine or a metal; phosphate ester salts and sulfate ester salts such as sodium dialkylsulfosuccinate; saponified polymer surfactants produced from olefin (e.g., styrene) and maleic anhydride polymer or the like; and naphthalenesulfonic acid-formalin condensate polymer surfactants.

Generally, the amount of surfactant incorporated into the water-soluble working fluid is preferably 3 to 50 mass % based on the total amount of the water-soluble working fluid (undiluted).

Examples of the mineral oil or synthetic oil serving as the lubricating oil base oil include mineral oils such as paraffin oil and naphthenic oil; linear olefins such as poly-α-olefin (e.g., decene oligomer or polyisobutylene), 1-tetradecene, 1-hexadecene, and 1-octadecene; alkylbenzenes; fats and oils; polyol esters; and polyglycols such as polyalkylene glycol and an ester derivative thereof.

These mineral oils and synthetic oils preferably have a kinematic viscosity at 40° C. of 5 to 50 $mm^2/s$.

Generally, the amount of lubricating oil base oil incorporated into the water-soluble working fluid is preferably 10 to 80 mass % based on the total amount of the water-soluble working fluid (undiluted).

Examples of the preservative (bactericide) include triazine-based preservatives and alkylbenzimidazole-based preservatives.

Examples of the metal deactivator include benzotriazoles and benzothiazoles.

Examples of the defoaming agent include silicones and fluorosilicones.

EXAMPLES

The present invention will next be described in more detail by way of examples, which should not be construed as limiting the invention thereto.

The performance of each water-soluble working fluid was evaluated through the following procedures.

1. Machining Performance

Each water-soluble working fluid was diluted with water to a concentration of 5 vol. %, and drilling for prepared holes was performed with the working fluid under the following conditions. Thereafter, form roll tapping was performed. The tap torque in form roll tapping was measured, and evaluated based on the following ratings.

<Working Conditions for Drilling for Prepared Holes and Form Roll Tapping>

Machine: Tapping center MTV-T350 (Mectron Inc.)
Work piece: aluminum alloy A6061
Drilling conditions:
Tool: Igetalloy Supermulti Drill MDS093MG (T4120, ϕ:9.3, Sumitomo Electric Hardmetal Corp.)
Speed: 80 m/min
Feed: 0.15 mm/rev
Depth: 30 mm (blind hole)
Tapping conditions:
Tool: New Roll (OGS Corporation)
Tap: B-NRT, M10×P1.5
Speed: 20 m/min
Depth: 25 mm
No. of work pieces (n): 9

<Working Performance Evaluation>

Excellent: torque <7 N·m
Good: torque ≧7 N·m and <8 N·m
Fair: torque ≧8 N·m

2. Rotting Resistance

To each water-soluble metal working fluid diluted with water to a concentration of 3 vol. % (sample volume: 100 mL), the below-described rotten liquid A (5 mL) and rotten liquid B (0.5 mL) were added, and the mixture was subjected to shake culturing at 30° C. and 150 rpm for 7 days. After completion of shake culturing, the number of viable cells was counted. After cell counting (day 7), rotten liquid A (2.5 mL) and rotten liquid B (0.25 mL) were further added to the culture, and the resultant mixture was further shake-cultured for 7 days. After completion of the second shake culturing, the number of viable cells was counted. The rotting test conditions and the procedure of viable cell counting are as follows.

<Rotting Test Conditions>

Culturing conditions: FC200 dry shavings (3 g) were added to the sample. The mixture was shaken at 30° C. and 150 rpm.

Rotten liquid A: An SCD medium "Daigo" (Nihon Pharmaceutical Co., Ltd.) was added to an emulsion-type cutting liquid which had been deteriorated via rotting, and the mixture was activated through aeration for 72 hours.

Rotten liquid B: A potato dextrose agar medium "Daigo" (Nihon Pharmaceutical Co., Ltd.) was added to an emulsion-type cutting liquid which had been deteriorated via rotting, and the mixture was activated through aeration for 72 hours.

<Viable Cell Counting>

The number of bacterial cells in a sample (1 mL) and the degree of contamination were determined by means of a "San-Ai Bio-checker" (San-Ai Oil Co. Ltd.), and the obtained viable cell counts were evaluated through the following ratings. The viable cell counts on day 14 were evaluated through the following criteria of evaluation, to thereby determine rotting resistance.

<Evaluation of Viable Cell Counts>

(i) Standard Plate Count Bacteria (General Bacteria) (6 Levels):

Not detected (n.d.) ($<10^3$ cells/mL), $10^3$ ($\geqq 10^3$ cells/mL and $<10^4$ cells/mL, the same being applied), $10^4$ ($\geqq 10^4$ cells/mL and $<10^5$ cells/mL, the same being applied), $10^5$ ($\geqq 10^5$ cells/mL and $<10^6$ cells/mL, the same being applied), $10^6$ ($\geqq 10^6$ cells/mL and $<10^7$ cells/mL, the same being applied), and $10^7$ ($\geqq 10^7$ cells/mL and $<10^8$ cells/mL).

(ii) Mold (3 Levels):

Not detected (n.d.), low, medium, and high.

(iii) Yeast (5 Levels):

Not detected (n.d. , $<10^3$ cells/mL), $10^3$, $10^4$, $10^5$, and $10^6$.

(iv) Anaerobe (3 Levels)

Not detected (n.d.), low, medium, and high.

<Score of Rotting Resistance>

Good: n.d. to $10^3$ cells/mL (or low)
Fair: $10^4$ cells/mL to $10^5$ cells/mL (or medium)
Poor: $\geqq 10^6$ cells/mL (or high)

Examples 1 to 2 and Comparative Examples 1 to 6

Working fluid samples of the Examples and the Comparative Examples having formulations shown in Table 2 were prepared. Each working fluid sample was diluted with water, and working performance when the working fluid sample was used was evaluated. Table 2 shows the results.

TABLE 2

| | | Ex. 1 | Ex. 2 | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|---|---|
| Amount (mass %) | Methyldicyclohexylamine | 7 | 20 | | | | | | |
| | Dicyclohexylamine | | | 7 | | | | | |
| | Di-n-octylamine | | | | 7 | | | | |
| | Di-2-ethylhexylamine | | | | | 7 | | | |
| | Diethylcyclohexylamine | | | | | | 7 | | |
| | Dibenzylamine | | | | | | | 7 | |
| | N-cyclohexyldiethanolamine | | | | | | | | 7 |
| | Monoisopropanolamine | 6 | | 6 | 6 | 6 | 6 | 6 | 6 |
| | Fatty acid mixt. I*[1] | 23 | 23 | 23 | 23 | 23 | 23 | 23 | 23 |
| | Polyoxyethylene-propylene monoalkyl ether*[2] | 3 | 6 | 3 | 3 | 3 | 3 | 3 | 3 |
| | Mineral oil*[3] | 50 | 40 | 50 | 50 | 50 | 50 | 50 | 50 |
| | Benzotriazole (metal deactivator) | 1 | 1 | 1 | 1 | 1 | 1 | 1 | 1 |
| | Water | 10 | 10 | 10 | 10 | 10 | 10 | 10 | 10 |
| Scores | Torque at working (Nm) | 7.6 | 6.2 | 7.8 | 7.7 | 8.0 | 8.5 | 8.4 | 8.2 |
| | Rating | Good | Excellent | Good | Good | Fair | Fair | Fair | Fair |

[Notes]

*[1]Fatty acid mixt. I: a mixture of dodecanedioic acid, neodecanoic acid, toll oil fatty acid, and risinoleic acid polymerized fatty acid (castor oil polymerized fatty acid)

*[2]Polyoxyethylene-propylene monomyristyl ether (HLB: 13)

*[3]Naphthenic mineral oil (kinematic viscosity (40° C.): 9.5 $mm^2/s$)

Examples 3 to 10 and Comparative Examples 7 to 18

Working fluid samples of the Examples and the Comparative Examples having formulations shown in Table 3 were prepared. The rotting resistance of each sample was evaluated. Table 3 shows the results.

TABLE 3

| | | | | Ex. 3 | Ex. 4 | Ex. 5 | Ex. 6 | Ex. 7 | Ex. 8 | Ex. 9 | Ex. 10 |
|---|---|---|---|---|---|---|---|---|---|---|---|
| Amount (mass %) | Methyldicyclohexylamine | | | 7 | 20 | 7 | 20 | 7 | 7 | 7 | 7 |
| | Monoisopropanolamine | | | 6 | | 6 | | 6 | 6 | 6 | 6 |
| | Fatty acid mixt. I*[1] | | | 23 | 23 | 23 | 23 | | | | |
| | Fatty acid mixt. II*[4] | | | | | | | 13 | 13 | 13 | 13 |
| | Polyoxyethylene-propylene monoalkyl ether*[2] | | | 3 | 6 | 3 | 6 | | | | |
| | Mineral oil*[3] | | | 50 | 40 | 49 | 39 | | | | |
| | PAG (PO-EO-PO block polymer)*[5] | | | | | | | | | 20 | 20 |
| | Benzotriazole (metal deactivator) | | | 1 | 1 | 1 | 1 | 1 | 1 | 1 | 1 |
| | Triazine bactericide | | | | | 1 | 1 | | 1 | | 1 |
| | Water | | | 10 | 10 | 10 | 10 | 73 | 72 | 53 | 52 |
| Results | Rotting resistance (viable cell count) | Day 7 | Bacteria | $10^3$ | n.d. | n.d. | n.d. | $10^3$ | $10^3$ | $10^3$ | $10^3$ |
| | | | Mold | n.d. | n.d. | n.d. | n.d. | n.d. | n.d. | n.d. | n.d. |
| | | | Yeast | n.d. | n.d. | n.d. | n.d. | n.d. | n.d. | n.d. | n.d. |
| | | | Anaerobe | n.d. | n.d. | n.d. | n.d. | n.d. | n.d. | n.d. | n.d. |
| | | Day 14 | Bacteria | $10^3$ | $10^3$ | $10^3$ | $10^3$ | $10^3$ | $10^3$ | $10^3$ | $10^3$ |
| | | | Mold | n.d. | n.d. | n.d. | n.d. | n.d. | n.d. | n.d. | n.d. |
| | | | Yeast | n.d. | n.d. | n.d. | n.d. | n.d. | n.d. | n.d. | n.d. |
| | | | Anaerobe | Low | n.d. | n.d. | n.d. | n.d. | n.d. | n.d. | n.d. |
| | Rotting resistance score | | Bacteria | Good | Good | Good | Good | Good | Good | Good | Good |
| | | | Mold | Good | Good | Good | Good | Good | Good | Good | Good |
| | | | Yeast | Good | Good | Good | Good | Good | Good | Good | Good |
| | | | Anaerobe | Good | Good | Good | Good | Good | Good | Good | Good |
| | | | Total score*[6] | 8 | 8 | 8 | 8 | 8 | 8 | 8 | 8 |

| | | Comp. Ex. 7 | Comp. Ex. 8 | Comp. Ex. 9 | Comp. Ex. 10 | Comp. Ex. 11 | Comp. Ex. 12 |
|---|---|---|---|---|---|---|---|
| Amount (mass %) | Dicyclohexylamine | 7 | | | | | |
| | Di-n-octylamine | | 7 | | | | |
| | Di-2-ethylhexylamine | | | 7 | | | |
| | Diethylcyclohexylamine | | | | 7 | | |
| | Dibenzylamine | | | | | 7 | |
| | N-cyclohexyldiethanolamine | | | | | | 7 |
| | Monoisopropanolamine | 6 | 6 | 6 | 6 | 6 | 6 |
| | Fatty acid mixt. I*[1] | 23 | 23 | 23 | 23 | 23 | 23 |
| | Polyoxyethylene-propylene monoalkyl ether*[2] | 3 | 3 | 3 | 3 | 3 | 3 |
| | Mineral oil*[3] | 50 | 50 | 50 | 50 | 50 | 50 |
| | Benzotriazole (metal deactivator) | 1 | 1 | 1 | 1 | 1 | 1 |

TABLE 3-continued

| | | | | Ex. 3 | Ex. 4 | Ex. 5 | Ex. 6 | Ex. 7 | Ex. 8 | Ex. 9 | Ex. 10 |
|---|---|---|---|---|---|---|---|---|---|---|---|
| | | Triazine bactericide | | | | | | | | | |
| | | Water | | | 10 | 10 | 10 | 10 | | 10 | 10 |
| Results | Rotting resistance (viable cell count) | Day 7 | Bacteria | | $10^3$ | $10^7$ | $10^7$ | $10^4$ | | $10^4$ | $10^7$ |
| | | | Mold | | n.d. | n.d. | High | Low | | n.d. | High |
| | | | Yeast | | n.d. | n.d. | $10^6$ | n.d. | | n.d. | $10^6$ |
| | | | Anaerobe | | High | Low | Low | High | | High | High |
| | | Day 14 | Bacteria | | $10^4$ | $10^7$ | $10^7$ | $10^7$ | | $10^7$ | $10^7$ |
| | | | Mold | | n.d. | n.d. | High | Low | | n.d. | High |
| | | | Yeast | | n.d. | n.d. | $10^6$ | $10^4$ | | n.d. | $10^6$ |
| | | | Anaerobe | | High | High | High | High | | High | High |
| | Rotting resistance score | | Bacteria | | Fair | Poor | Poor | Poor | | Poor | Poor |
| | | | Mold | | Good | Good | Poor | Good | | Good | Poor |
| | | | Yeast | | Good | Good | Poor | Fair | | Good | Poor |
| | | | Anaerobe | | Poor | Poor | Poor | Poor | | Poor | Poor |
| | | | Total score*6 | | 5 | 4 | 0 | 3 | | 4 | 0 |

| | | | | Comp. Ex. 13 | Comp. Ex. 14 | Comp. Ex. 15 | Comp. Ex. 16 | Comp. Ex. 17 | Comp. Ex. 18 |
|---|---|---|---|---|---|---|---|---|---|
| Amount (mass %) | Dicyclohexylamine | | | 7 | | | | | |
| | Di-n-octylamine | | | | 7 | | | | |
| | Di-2-ethylhexylamine | | | | | 7 | | | |
| | Diethylcyclohexylamine | | | | | | 7 | | |
| | Dibenzylamine | | | | | | | 7 | |
| | N-cyclohexyldiethanolamine | | | | | | | | 7 |
| | Monoisopropanolamine | | | 6 | 6 | 6 | 6 | 6 | 6 |
| | Fatty acid mixt. I*1 | | | 23 | 23 | 23 | 23 | 23 | 23 |
| | Polyoxyethylene-propylene monoalkyl ether*2 | | | 3 | 3 | 3 | 3 | 3 | 3 |
| | Mineral oil*3 | | | 49 | 49 | 49 | 49 | 49 | 49 |
| | Benzotriazole (metal deactivator) | | | 1 | 1 | 1 | 1 | 1 | 1 |
| | Triazine bactericide | | | 1 | 1 | 1 | 1 | 1 | 1 |
| | Water | | | 10 | 10 | 10 | 10 | 10 | 10 |
| Results | Rotting resistance (viable cell count) | Day 7 | Bacteria | $10^3$ | $10^5$ | $10^7$ | $10^3$ | $10^5$ | $10^3$ |
| | | | Mold | n.d. | n.d. | High | n.d. | n.d. | n.d. |
| | | | Yeast | n.d. | n.d. | $10^5$ | n.d. | n.d. | n.d. |
| | | | Anaerobe | High | Medium | Low | Medium | High | High |
| | | Day 14 | Bacteria | $10^3$ | $10^7$ | $10^7$ | $10^5$ | $10^6$ | $10^7$ |
| | | | Mold | n.d. | n.d. | High | n.d. | n.d. | High |
| | | | Yeast | n.d. | n.d. | $10^6$ | $10^4$ | n.d. | n.d. |
| | | | Anaerobe | High | High | High | High | High | High |
| | Rotting resistance score | | Bacteria | Good | Poor | Poor | Fair | Poor | Poor |
| | | | Mold | Good | Good | Poor | Good | Good | Poor |
| | | | Yeast | Good | Good | Poor | Fair | Good | Good |
| | | | Anaerobe | Poor | Poor | Poor | Poor | Poor | Poor |
| | | | Total score*6 | 6 | 4 | 0 | 4 | 4 | 2 |

[Notes]
*1,*2,*3The same as employed in Table 2
*4Fatty acid mixt. II: A mixture of dodecanedioic acid, neodecanoic acid, and nonanoic acid
*5Polyalkylene glycol, ethyelen-propylene block (20:80) copolymer (mol. wt.: 3,000)
*6Total score: The sum of the individual scores (Good: 2, Fair: 1, and Poor: 0)

As is clear from Table 2, when the working fluid samples of Examples 1 and 2 containing methyldicyclohexylamine, which fall within the scope of the present invention, were employed, the torque at working was small, providing excellent working performance. In contrast, the working fluid sample of Comparative Example 1 containing dicyclohexylamine instead of methyldicyclohexylamine, and the working fluid samples of Comparative Examples 2 to 6 containing other amines exhibited working performance inferior to that attained with the sample of Example 1.

As is clear from Table 3, the working fluid samples of Examples 3 to 10 containing methyldicyclohexylamine, which fall within the scope of the present invention, exhibited excellent rotting resistance to all the tested bacteria. In contrast, the working fluid samples of Comparative Examples 7 and 13 containing dicyclohexylamine instead of methyldicyclohexylamine, exhibited poor rotting resistance to the tested anaerobe. The working fluid samples of Comparative Examples 8 to 12 and 14 to 18 containing other amines exhibited unsatisfactory rotting resistance to the anaerobe, general bacteria, and other bacterial.

Industrial Applicability

The water-soluble working fluid of the present invention less adversely affects the human body and the ecological system, which has higher rotting resistance, and which provides more excellent working performance, as compared with those conventionally attained. Therefore, the water-soluble working fluid of the present invention ensures safety, a long service life, and high quality, and can be effectively employed in a metal working process such as cutting, grinding, or plastic working.

The invention claimed is:

1. A water-soluble working fluid, comprising a fatty acid amine salt product obtained by reacting (A) methyldicyclohexylamine; and (B) at least one fatty acid selected from the group consisting of C8 to C30 fatty acid, a C8 to C30 hydroxyfatty acid, and a C8 to C30 aliphatic dicarboxylic acid; or at least one fatty acid derivative selected from the group consisting of a dimmer of the fatty acid and a polycondensate of the hydroxyfatty acid.

2. A water-soluble metal working fluid, comprising at least one fatty acid amine salt selected from the group consisting of a C8 to C30 fatty acid methyldicyclohexylamine salt, a C8 to C30 hydroxy fatty acid methyldicyclohexylamine salt, a C8 to C30 aliphatic dicarboxylic acid methyldicyclohexylamine salt, a dimer acid of C8 to C30 fatty acid methyldicyclohexylamine salt, and a polycondensate of C8 to C30 hydroxy fatty acid methyldicyclohexylamine salt.

3. The water-soluble working fluid according to claim 2, wherein the amount of the methyldicyclohexylamine salt of a fatty acid or the methyldicyclohexylamine salt of a fatty acid derivative in the working fluid is 10 to 70 mass % based on the total amount of the water-soluble working fluid.

4. The water-soluble working fluid according to claim 1, further comprising a surfactant.

5. The water-soluble working fluid according to claim 2, further comprising a surfactant.

6. The water-soluble working fluid according to claim 4, wherein the surfactant is present in an amount of 3 to 50 mass % based on the total amount of the water-soluble working fluid.

7. The water-soluble working fluid according to claim 5, wherein the surfactant is present in an amount of 3 to 50 mass % based on the total amount of the water-soluble working fluid.

8. The water-soluble working fluid according to claim 1, further comprising a lubricating oil base oil.

9. The water-soluble working fluid according to claim 2, further comprising a lubricating oil base oil.

10. The water-soluble working fluid according to claim 8, wherein the lubricating oil base oil is present in an amount of 10 to 80 mass % based on the total amount of the water-soluble working fluid.

11. The water-soluble working fluid according to claim 9, wherein the lubricating oil base oil is present in an amount of 10 to 80 mass % based on the total amount of the water-soluble working fluid.

12. The water-soluble working fluid according to claim 1, comprising at least one fatty acid selected from the group consisting of a C8 to C30 fatty acid, a C8 to C30 hydroxyfatty acid, and a C8 to C30 aliphatic dicarboxylic acid.

13. The water-soluble working fluid according to claim 1, comprising at least one fatty acid derivative selected from the group consisting of a dimer of the fatty acid and a polycondensate of the hydroxyfatty acid.

14. The water-soluble working fluid according to claim 5, comprising a C8 to C30 hydroxy fatty acid methyldicyclohexylamine salt, or a C8 to C30 aliphatic dicarboxylic acid methyldicyclohexylamine salt.

15. The water-soluble working fluid according to claim 5, comprising a polycondensate of C8 to C30 hydroxy fatty acid methyldicyclohexylamine salt, or a dimer acid of C8 to C30 hydroxy fatty acid methyldicyclohexylamine salt.

* * * * *